US012352129B2

(12) United States Patent
Alders et al.

(10) Patent No.: US 12,352,129 B2
(45) Date of Patent: Jul. 8, 2025

(54) COIL SHIFTABLE PACKER

(71) Applicant: TIER 1 ENERGY SOLUTIONS, INC., Edmonton (CA)

(72) Inventors: Ronald Scott Alders, Cold Lake (CA); Jeffrey Golinowski, Sherwood Park (CA); Daniel P. Lupien, Gainford (CA)

( * ) Notice: Subject to any disclaimer, the term of this patent is extended or adjusted under 35 U.S.C. 154(b) by 0 days.

(21) Appl. No.: 18/347,873

(22) Filed: Jul. 6, 2023

(65) Prior Publication Data

US 2024/0011366 A1 Jan. 11, 2024

Related U.S. Application Data

(60) Provisional application No. 63/358,729, filed on Jul. 6, 2022.

(51) Int. Cl.

| | |
|---|---|
| ***E21B 33/128*** | (2006.01) |
| ***E21B 33/124*** | (2006.01) |
| ***E21B 43/14*** | (2006.01) |
| ***E21B 43/24*** | (2006.01) |

(52) U.S. Cl.

CPC ..... *E21B 33/128* (2013.01); *E21B 33/124* (2013.01); *E21B 43/14* (2013.01); *E21B 43/24* (2013.01)

(58) Field of Classification Search

CPC ..... E21B 33/128; E21B 33/122; E21B 23/06; E21B 33/124

See application file for complete search history.

(56) References Cited

U.S. PATENT DOCUMENTS

| | | | |
|---|---|---|---|
| 3,051,243 | A | 8/1962 | Grimmer et al. |
| 3,071,193 | A | 1/1963 | Raulins |
| 3,395,758 | A | 8/1968 | Kelly et al. |
| 5,156,220 | A | 10/1992 | Forehand et al. |
| 9,115,565 | B1 | 8/2015 | Richards et al. |
| 9,593,545 | B2 | 3/2017 | Churchill |
| 10,123,332 | B2 | 11/2018 | Wakabayashi |
| 10,288,328 | B2 | 5/2019 | Yang et al. |

(Continued)

FOREIGN PATENT DOCUMENTS

| | | | |
|---|---|---|---|
| CA | 3205536 | A1 | 1/2024 |
| WO | WO2008146012 | A2 | 12/2008 |
| WO | WO-2024010837 | A1 * | 1/2024 |

*Primary Examiner* — Tara Schimpf
*Assistant Examiner* — Ursula Lee Norris
(74) *Attorney, Agent, or Firm* — Bennett Jones LLP

(57) ABSTRACT

A packer assembly includes (a) a mandrel bearing an expandable packer element, the mandrel having a ratchet section, a lower collet retaining shoulder, and defining a plurality of longitudinal slots; (b) a push sleeve connected to a ratchet ring by at least one shear pin, wherein the ratchet ring is disposed between push sleeve and the mandrel and engages the mandrel ratchet section; (c) a shift sleeve comprising an inner shift sleeve slidingly disposed within the mandrel and having a lower collet, the inner shift sleeve defining a profile for engaging a shifting tool, and an outer shift sleeve slidingly around the mandrel and connected to the inner shift sleeve with a plurality of bolts, wherein each bolt passes through a longitudinal slot defined by the mandrel; (d) wherein the shift sleeve and push sleeve is moveable between a running position and a released position. Also disclosed are methods of using a packer actuated by a sliding sleeve.

3 Claims, 6 Drawing Sheets

RUN IN HOLE POSITION

(56) References Cited

U.S. PATENT DOCUMENTS

| | | | |
|---|---|---|---|
| 10,502,025 | B2 | 12/2019 | Van Petegem et al. |
| 10,597,977 | B2 | 3/2020 | Thomas et al. |
| 10,648,287 | B2 | 5/2020 | Styler et al. |
| 11,761,316 | B2 | 9/2023 | Alders et al. |
| 2024/0011366 | A1 | 1/2024 | Alders et al. |

* cited by examiner

RUN IN HOLE POSITION

SET POSITION

SHEARED/RELEASED POSITION

COIL SHIFTABLE PACKER

This application claims the priority benefit of U.S. Provisional Patent Application No. 63/358,729, filed Jul. 6, 2022, the entire contents of which are incorporated herein by reference.

FIELD OF THE INVENTION

The present invention generally relates to a packer which may be set by a hydro-mechanical shifting tool run on coiled tubing, and methods of using the packer to selectively isolate desired zones in a wellbore.

BACKGROUND

Steam-assisted gravity drainage (SAGD) is a technique for recovering viscous hydrocarbons (e.g., heavy crude oil and bitumen) that do not readily flow under normal reservoir conditions. SAGD involves injecting steam into an injection tubing string of a horizontal injection well, and allowing the steam to flow into the surrounding formation to reduce the viscosity of the hydrocarbons in the formation. The reduced-viscosity hydrocarbons flow downward into a substantially horizontal production well which runs parallel to the injection well, and are pumped to the surface through a production tubing string of the production well.

The injection tubing string may include multiple packers for isolating sections of the wellbore, which packers may be set using hydraulic pressure. Typically, all the packers in the injection well will be set at substantially the same time, either simultaneously or in close sequential order.

There remains a need in the art for a packer which may be set or unset, independently of the other packers in the tubing string.

SUMMARY OF THE INVENTION

In one aspect, disclosed is a coil shiftable packer assembly which comprises:

(a) a mandrel bearing an expandable packer element, the mandrel comprising a ratchet section, a lower collet retaining shoulder, and defining a plurality of longitudinal slots;

(b) a push sleeve connected to a ratchet ring by at least one shear pin, wherein the ratchet ring is disposed between the push sleeve and the mandrel, engaging the mandrel ratchet section;

(c) a shift sleeve comprising an inner shift sleeve disposed within the mandrel and having a lower collet, the inner shift sleeve defining a profile for engaging a shifting tool, and an outer shift sleeve slidingly disposed around the mandrel and connected to the inner shift sleeve with a plurality of bolts, wherein each bolt passes through a longitudinal slot in the mandrel;

(d) wherein the shift sleeve and push sleeve are moveable between a:

i. running position wherein the collet is retained by the mandrel retaining shoulder;

ii. set position wherein the collet is disengaged and the shift sleeve and push sleeve have slid upwards on the mandrel, compressing the packer element longitudinally to expand radially outwards, wherein the push sleeve is maintained in the set position by the ratchet ring engaging the mandrel ratchet section, and iii. released position wherein the shift sleeve and push sleeve has returned to its running position by shearing the at least one shear pin connecting the push sleeve and the ratchet ring.

In some embodiments, the shifting tool is deployed on coil tubing.

In another aspect, disclosed is a method of setting a packer assembly which comprises (a) a mandrel bearing an expandable packer element, the mandrel comprising a ratchet section, a lower collet retaining shoulder, and defining a plurality of longitudinal slots; (b) a push sleeve connected to a ratchet ring by at least one shear pin, wherein the ratchet ring is disposed between push sleeve and the mandrel, engaging the mandrel ratchet section; (c) a shift sleeve comprising an inner shift sleeve disposed within the mandrel, the inner shift sleeve defining a profile for engaging a shifting tool, and an outer shift sleeve slidingly disposed around the mandrel and connected to the inner shift sleeve with a plurality of bolts, wherein each bolt passes through a longitudinal slot; wherein the method comprises the steps of:

(a) running a shifting tool into the packer assembly and actuating the tool to engage the inner shift sleeve profile; and (b) pulling the shifting tool move the shift sleeve and push sleeve along the mandrel to actuate the packer element by compressing it longitudinally to expand radially outwards, wherein the push sleeve is maintained in a set position by the ratchet ring.

In some embodiments, the method further comprises the step of pulling on the mandrel to shear the at least one shear pin and move the shift sleeve and push sleeve to a released position, thereby decompressing the packer element longitudinally.

In some embodiments, the method comprises the further steps of installing a steam diverter uphole from a first packer and downhole of a second packer, using the same shifting tool to actuate the first and second packers and the steam diverter, to create a first isolated steam zone. Additional steam zones, isolated from each other may be created by installing and actuating multiple packers and steam diverters in the injection string. The first packer may be placed at or near the toe of the well.

In an alternative embodiment, a terminal steam diverter may be placed at or near the toe of the well, followed by a packer uphole from the steam diverter. In this case, a terminal steam zone at the toe of the well will be bounded only at the uphole end by a packer. The shifting tool may then actuate the terminal steam diverter followed by the packer.

In another aspect, disclosed is a steam injection tubing string, comprising a plurality of alternating packers and steam diverters, wherein the packers are each configured with a sliding sleeve to be selectively actuated to isolate an annular space between the tubing string and a liner, and wherein the steam diverters are configured with a sliding sleeve to be selectively actuated to permit passage of steam through an opening in the tubing string to the annular space, wherein each packer and each steam diverter may be actuated by the same position shifting tool.

In another aspect, the invention may comprise a method of creating at least two steam injection zones, comprising the steps of:

(a) installing a steam injection tubing string, comprising a plurality of alternating packers and steam diverters, wherein the packers are each configured with a sliding sleeve to be selectively actuated to isolate an annular space between the tubing string and a liner, and wherein the steam diverters are configured with a sliding sleeve to be selectively actuated to permit passage of steam through an opening in the tubing string to the annular space, wherein each packer and each steam diverter may be actuated by the same position shifting tool;

(b) actuating the packers and steam diverters in one or more trips with a position shifting tool, preferably the same position shifting tool.

In some embodiments, where a plurality of steam zones are created by the installation of a plurality of packers and a plurality of steam diverters, each packer and each steam diverter may be shifted in a single trip with the same shifting tool. Alternatively, all the packers could be shifted in a first trip followed by a second trip to shift the steam injectors open, all with the same shifting tool.

BRIEF DESCRIPTION OF THE FIGURES

The accompanying drawings, which are incorporated herein and form a part of the specification, illustrate some, but not the only or exclusive, examples of embodiments and/or features. The Figures are not drawn to-scale.

DETAILED DESCRIPTION

Figure 1:
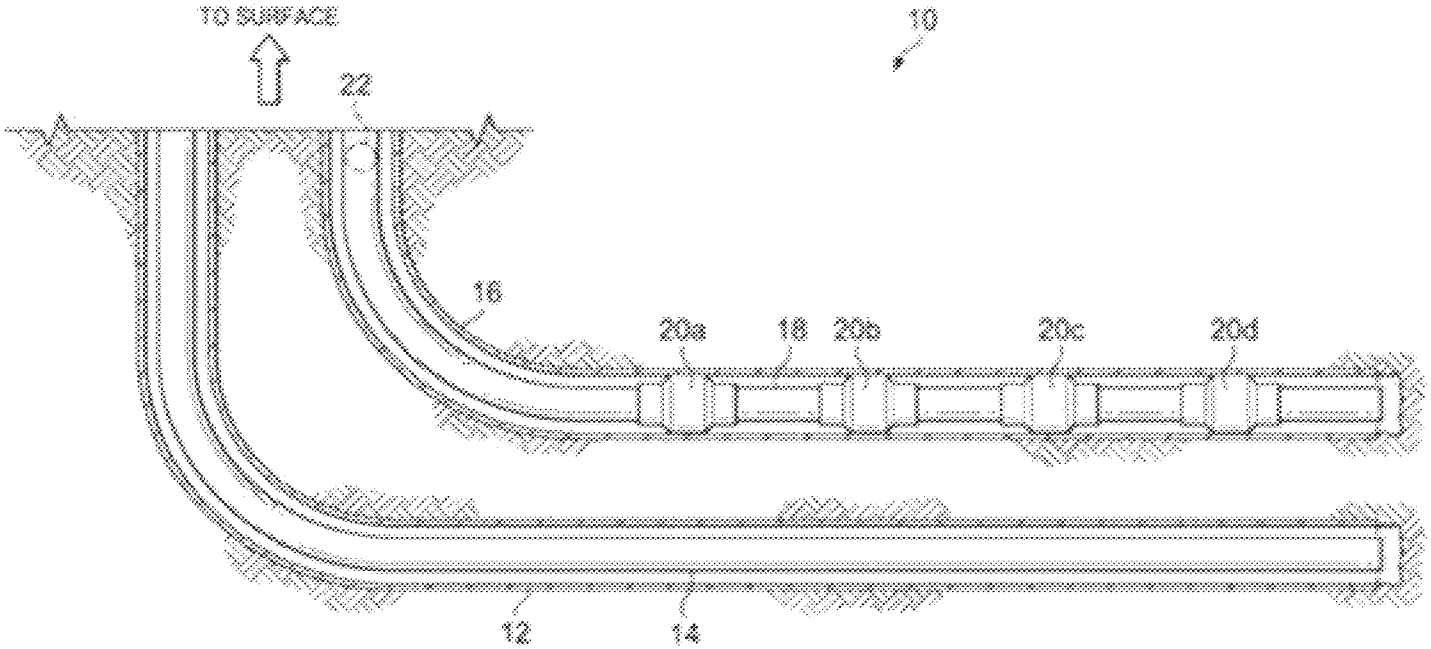
FIG. 1 shows a schematic depiction of a steam injection well positioned above a production wellbore.

The present invention now will be described more fully hereinafter with reference to the accompanying drawings, in which some, but not all embodiments of the invention are exemplified. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation. Conventional components of the invention are elements that are well-known in the prior art and will not be discussed in detail for this disclosure.

FIG. 1 shows a schematic depiction of a steam injection well 10 positioned above a conventional production wellbore with casing 12 and production tubing 14. Multiple packer assemblies 20*a*, 20*b*, 20*c*, 20*d* are implemented along the length of the injection wellbore, which, when deployed, seal the annular space between the tubing string and a slotted liner 18.

Figure 2:
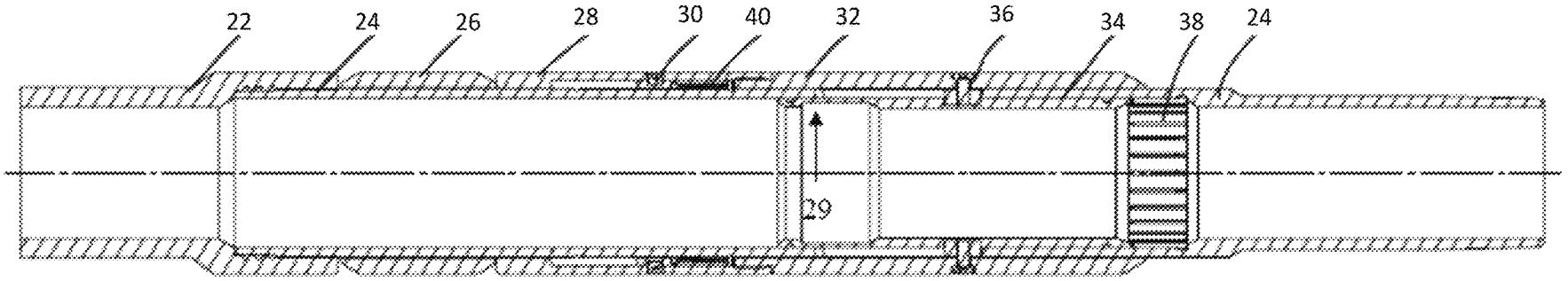
FIG. 2 shows a longitudinal cross-sections of one embodiment of a coil shiftable packer in a "run-in-hole" position.
Figure 3:
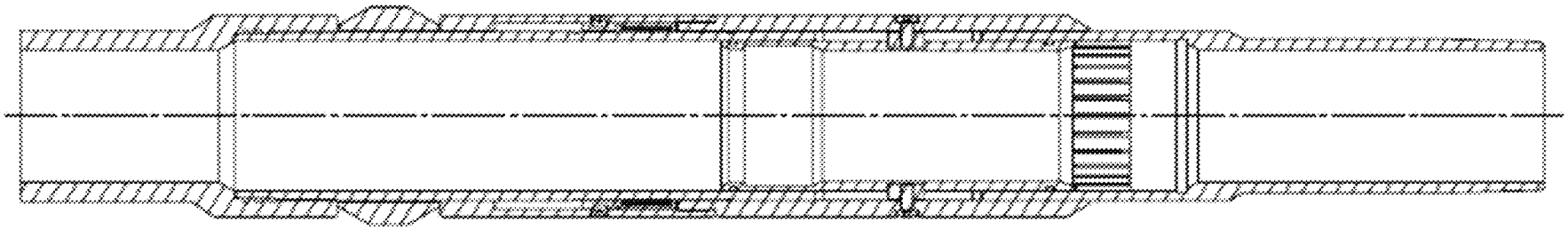
FIG. 3 shows the packer of FIG. 2 in a set position.
Figure 4:
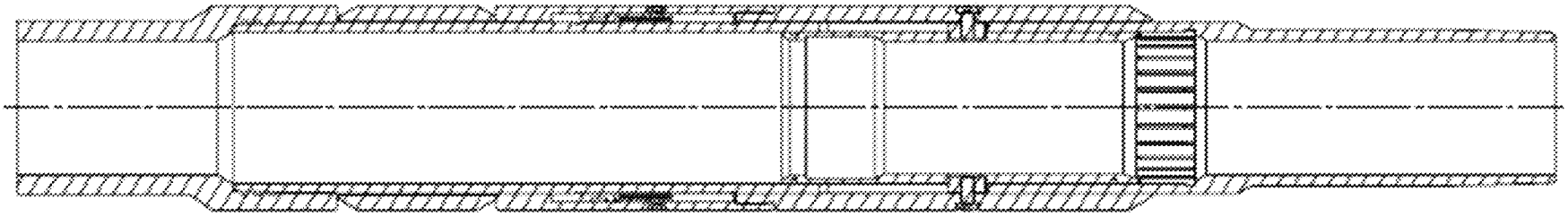
FIG. 4 shows the packer of FIG. 2 in a sheared or released position.
Figure 5:
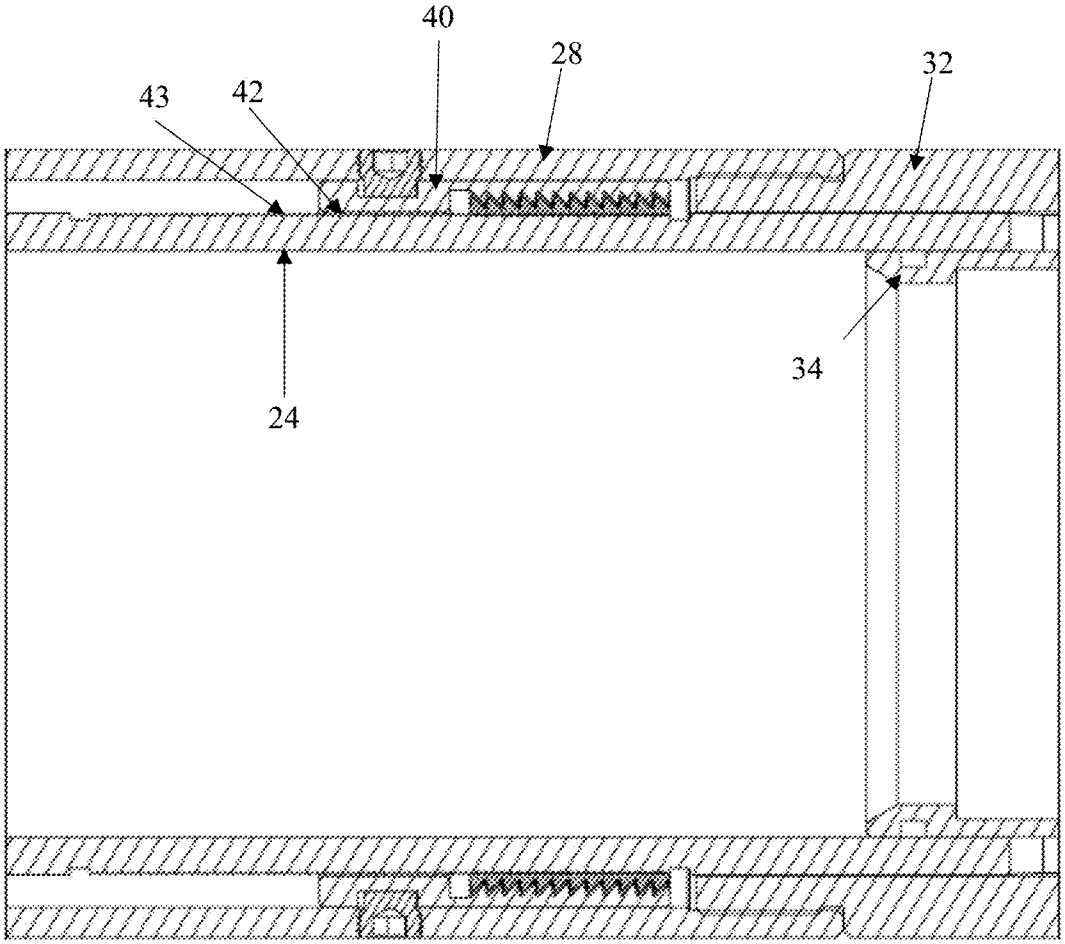
FIG. 5 shows a detailed view of the ratchet ring of the packer shown in FIGS. 2-4.

FIGS. 2-4 show longitudinal cross-sections of one embodiment of a coil shiftable packer 20 of the present invention, and FIG. 5 shows a detailed view of a ratchet ring.

The packer 20 comprises a top sub 22 and a mandrel 24. An upper end of the top sub 22 is configured for removable attachment to the tubing string. The mandrel 24 is a hollow tubular member which runs the length of the assembly, and has a lower end configured for removable attachment to the tubing string. An expandable packer element 26 is disposed concentrically around the mandrel 24, between the top sub 22 and a push sleeve 28. Longitudinal movement of the push sleeve 28 towards the top sub 22 compresses the packer element 26 longitudinally such that it expands radially outwards. The packer element 26 preferably comprises a resilient elastomer, having a suitable temperature rating for the conditions in the intended use case.

Shear pins 30 connect the push sleeve 28 to a ratchet ring 40 which abuts an outer shift sleeve 32, which ratchet ring 40 is positioned concentrically between the push sleeve 28 and the mandrel 24. An inner shift sleeve 34 is positioned within the mandrel 24 and is connected to the outer shift sleeve 32 by means of bolts 36, which can move within longitudinal slots formed in the mandrel 24. Thus, the inner shift sleeve 34 and the outer shift sleeve 32 move in unison, relative to the stationary mandrel 24.

The inner shift sleeve 34 comprises a lower collet 38, having collet fingers which releasably engage a shoulder formed by a circumferential groove in an inner surface of the mandrel. The lower end of the mandrel 24 is blanked for a conventional pin connection.

The ratchet ring 40 is slidingly disposed between the push sleeve 28 and the mandrel 24. The ratchet ring 40 has inner ratchet teeth 42 which engage complementary external ratchet teeth 43 on the mandrel. The ratchet ring 40 may move upwardly along the mandrel 24, but not downwardly due to the ratchet teeth 42, 43 on the ratchet ring and mandrel.

The packer assembly is shown in its running position in FIG. 2. The collet 38 is retained in running position within the mandrel 24 and the push sleeve 28 is in an extended position. When it is desired to set the packer, a hydromechanical shifting tool (not shown) may be run into the tubing and positioned within the inner shift sleeve, as is well known in the art. The shifting tool is actuated and an external profile engages the internal profile 29 of the shift sleeve. Once engaged, the packer may be set by pulling the inner shift sleeve upward to release the collet 38.

The set position is shown in FIG. 3. Actuation of the shift sleeve 28 has caused the push sleeve 28 to move upwards to actuate and expand the packer element 26. The ratchet sleeve 40 has moved in unison with the push sleeve due to the shear pins 30, and retains the engaged, expanded position of the packer.

To release the packer, the mandrel may be pulled to shear the shear pins 30, permitting the push sleeve 28 and the outer shift sleeve 32 to move downwards relative to the mandrel 24, while the ratchet ring 40 remains in place. The packer element 26 may then retract. The inner shift sleeve 34 and collet 38 then move to their run-in-hole position, where the collet 38 has engaged the inner surface of the mandrel 24, thereby preventing re-expansion of the packer 26.

The number and size of the shear pins 30 may be varied to vary the force necessary to release the packer in different applications.

Figure 7:
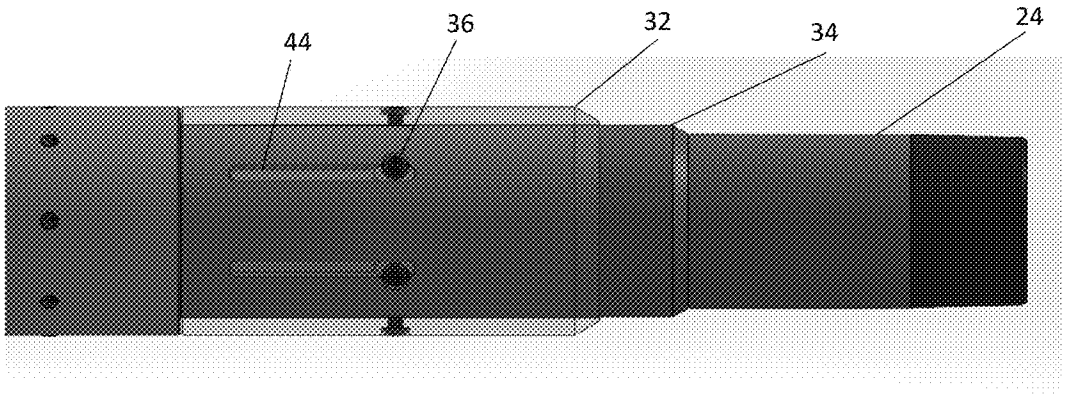
FIG. 7 shows an isometric view of one embodiment of the packer with the push sleeve transparent to illustrate the space between the outer shift sleeve and the mandrel.
Figure 8:
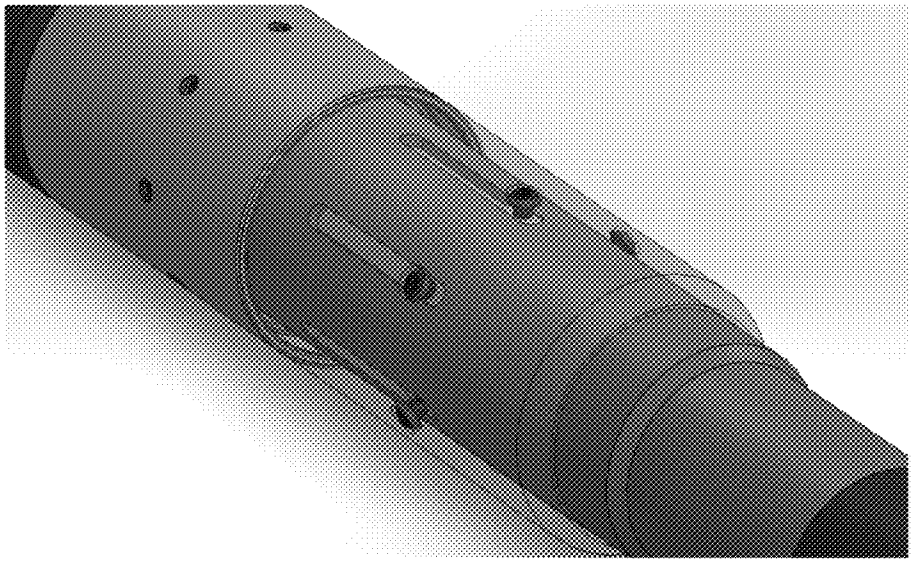
FIG. 8 shows a side view of the packer of FIG. 7.
Figure 9:
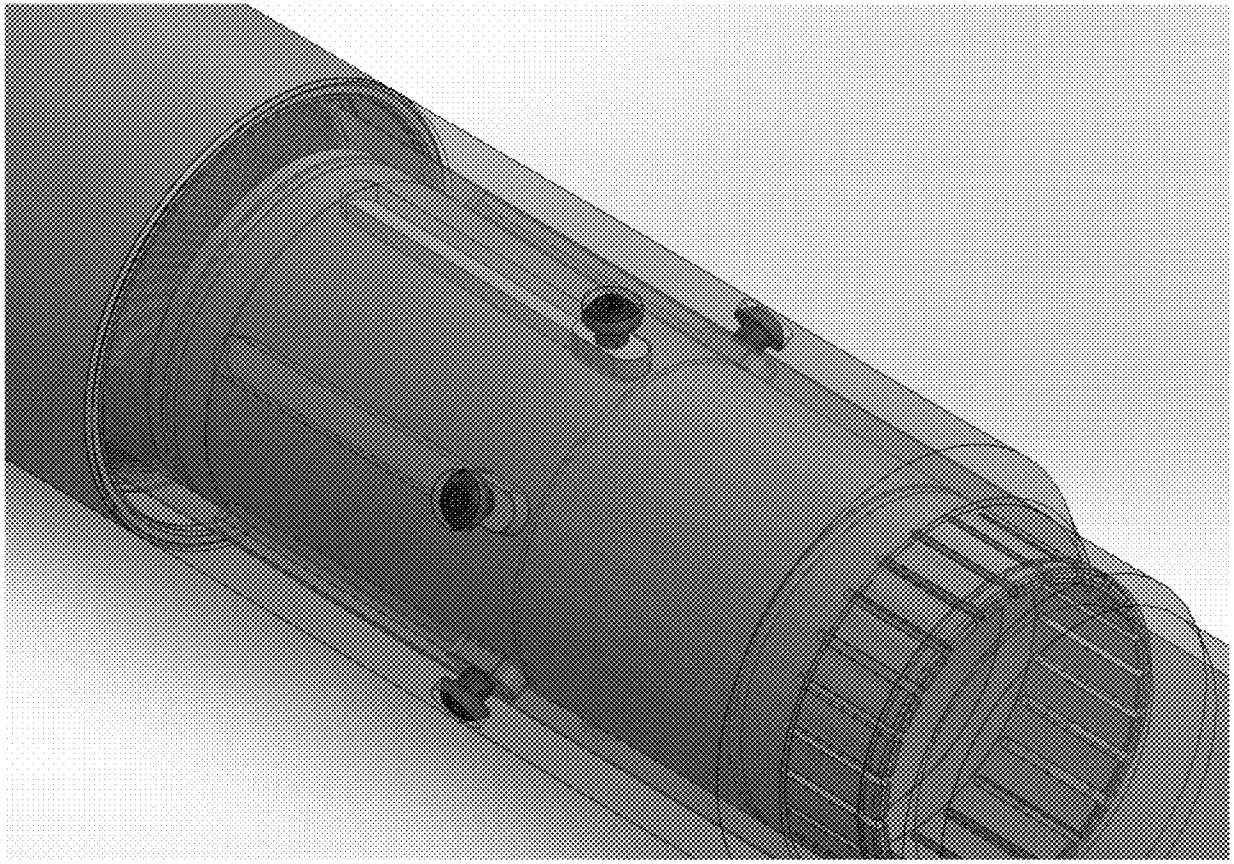
FIG. 9 shows the packer of FIG. 7 with both the push sleeve and mandrel transparent to illustrate the internal components of the packer.

FIG. 7 shows a coil shiftable packer 20 with the push sleeve 28 transparent to demonstrate the internal components of the packer. FIG. 8 shows the plurality of bolts 36 which connect the outer shift sleeve 32 to the inner shift sleeve 34, through longitudinal slots 44. FIG. 9 shows the same embodiment as FIG. 7 with the mandrel 24 transparent to show additional internal components of the packer 20.

Figure 6:
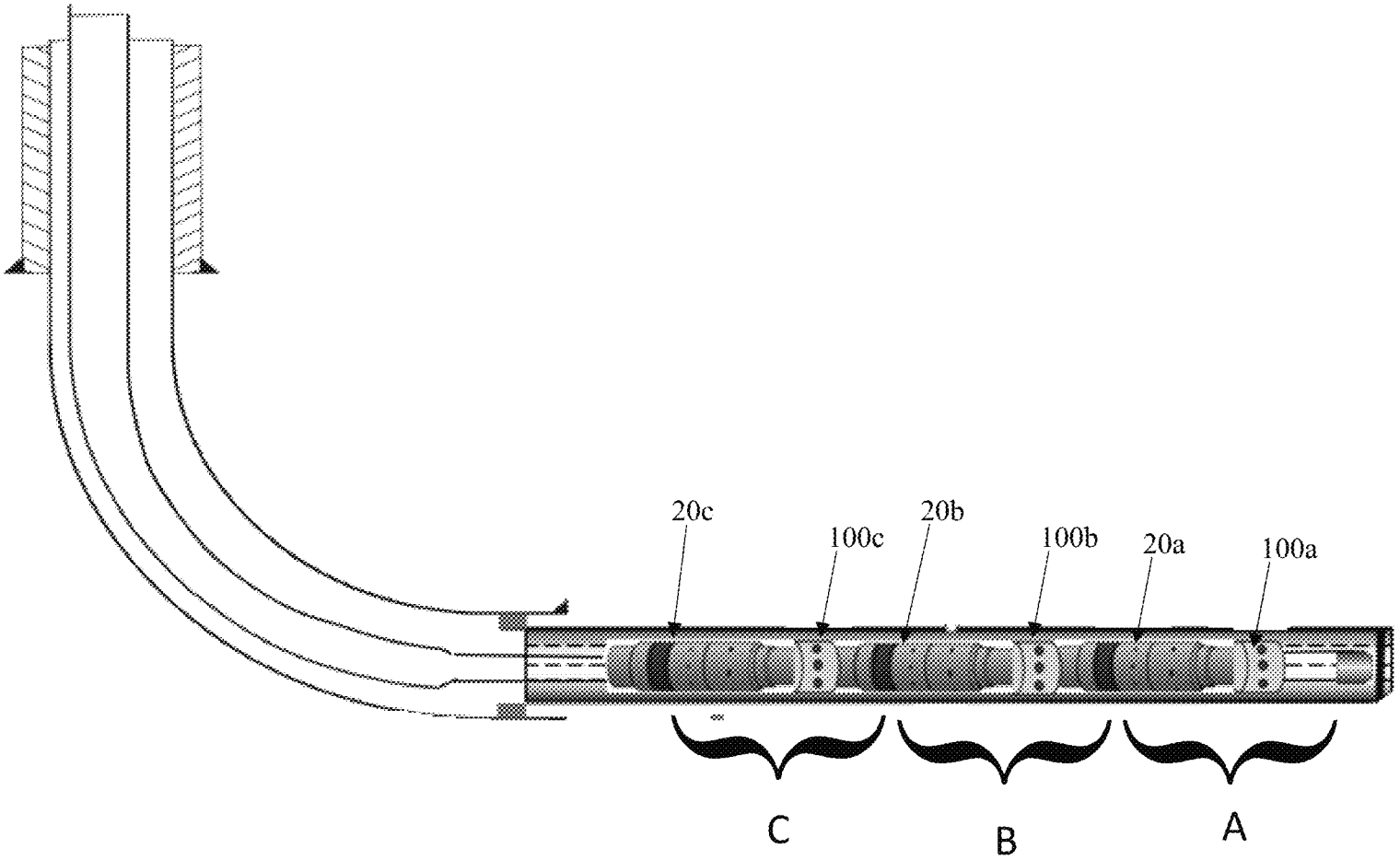
FIG. 6 shows a schematic depiction of a steam injection well with a series of installed steam diverters and coil shiftable packers, to create isolated steam zones.

In some embodiments, a coil shiftable packer 20 may be employed in combination with at least one steam diverter 100, as is shown in FIG. 6. Accordingly, a plurality of steam injection zones may be created with a steam diverter 100 disposed between adjacent packers 20. This provides the operator the flexibility and control to actuate individual steam injection zones, creating multiple configurations of steam chamber sizes.

The steam diverter 100 is used to control flow of steam from inside the injection tubing string to the formation surrounding the injection well. As described below, in some embodiments, the control of the flow of steam may be effected by movement of a shift sleeve, which opens steam passages. In alternative embodiments, the steam diverter may be actuated by other known methods. The shift sleeve may be actuated by a position shifting tool, preferably the same tool as that used to shift and actuate the packer 20. In this manner, a position shifting tool can be run into the injection well to actuate one or more packers 20 and one or more steam diverters. As used herein, the "same shifting tool" means that the external profile of the shifting tool may engage the shift profile of both the shift sleeve of the packer and the shift sleeve of the steam diverter, and thus may include different tools of the same type.

Position shifting tools such as hydro-mechanical shifting tools are well known in the art, and are configured to shift the position of a sliding sleeve within a downhole tool.

In some embodiments, the steam diverter may be actuated by other known methods. The steam diverter may be an apparatus as described in co-pending U.S. patent application Ser. No. 17/156,151, filed on Jan. 22, 2021, and entitled "Steam Diverter Apparatus and Method for Controlling Steam Flow in a Well", the entire contents of which are incorporated herein by reference.

In some embodiments, a method comprises assembling an injection well tubing string 17 comprising a plurality of alternating steam diverters 100 and packers 20 and positioning the tubing string such that a terminal steam diverter 100*a* is positioned at or near the toe of the well, followed by a packer 20*a* uphole from the steam diverter 100*a*. In this case, a terminal steam zone A at the toe of the well will be bounded only at the uphole end by packer 20*a*. The shifting tool may then actuate the terminal steam diverter 100*a* followed by the packer 20*a*. Additional steam zones (B, C etc.) may be created by alternating at least one steam diverter 100*b*, 100*c* between packers 20*b* and 20*c*, as depicted in FIG. 6.

In some embodiments, the injection tubing string comprises a terminal packer 20 placed at or near the toe of a well, followed by alternating steam diverters and packers.

In some embodiments, two or more steam diverters may be positioned within a steam zone bounded by uphole and downhole packers.

Multiples steam zones (for example A, B, C) may be actuated sequentially and/or in one trip with a position shifting tool. For example, where a plurality of steam zones are created by the installation of a plurality of packers and a plurality of steam diverters, each packer and each steam diverter may be shifted in a single trip with the same shifting tool. Alternatively, all the packers could be shifted in a first trip followed by a second trip to shift the steam injectors open, all with the same shifting tool. There are many combinations available to create multiple steam zones simultaneously, or in a desired order because each packer and steam diverter may be independently shifted by the shifting tool.

Interpretation

The forgoing description supplies specific details in order to provide a thorough understanding. Nevertheless, the skilled artisan would understand that the apparatuses, systems, and associated methods of using the apparatuses and systems can be implemented and used without employing these specific details. Indeed, the apparatuses, systems, and associated methods can be placed into practice by modifying the illustrated apparatus and associated methods and can be used in conjunction with any other apparatus and techniques conventionally used in the industry.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A packer assembly comprising:

(a) a mandrel bearing an expandable packer element, the mandrel comprising a ratchet section, a lower collet retaining shoulder, and defining a plurality of longitudinal slots;

(b) a push sleeve connected to a ratchet ring by at least one shear pin, wherein the ratchet ring is disposed between the push sleeve and the mandrel and engages the ratchet section;

(c) a shift sleeve system comprising an inner shift sleeve slidingly disposed within the mandrel and having a lower collet, the inner shift sleeve defining a profile for engaging a shifting tool, and an outer shift sleeve slidingly disposed around the mandrel and connected to the inner shift sleeve with a plurality of bolts, wherein each bolt passes through the plurality of longitudinal slots defined by the mandrel;

(d) wherein the shift sleeve system and the push sleeve is moveable between a running position wherein the lower collet is retained by the lower collet retaining shoulder and a set position wherein the lower collet is disengaged and the shift sleeve system and push sleeve has moved upwards on the mandrel, compressing the expandable packer element longitudinally to expand radially outwards, wherein the push sleeve is maintained in the set position by the ratchet ring engaging the ratchet section, and a released position wherein the shift sleeve and the push sleeve has returned to its running position by shearing the at least one shear pin connecting the push sleeve and the ratchet ring.

2. A method of setting a packer assembly, the packer assembly comprising: (a) a mandrel bearing an expandable packer element, the mandrel comprising a ratchet section, a lower collet retaining shoulder, and defining a plurality of longitudinal slots; (b) a push sleeve connected to a ratchet ring by at least one shear pin, wherein the ratchet ring is disposed between the push sleeve and the mandrel, engaging the ratchet section; (c) a shift sleeve system comprising an inner shift sleeve disposed within the mandrel, the inner sleeve defining a profile for engaging a shifting tool, and an outer sleeve slidingly disposed around the mandrel and connected to the inner shift sleeve with a plurality of bolts, wherein each bolt passes through a longitudinal slot of the plurality of longitudinal slots; the method comprising the steps of:

(a) running a shifting tool into the packer assembly and actuating the tool to engage the inner shift sleeve profile; and (b) pulling the shifting tool to move the shift sleeve system and the push sleeve along the mandrel to actuate the expandable packer element by compressing it longitudinally to expand radially outwards, wherein the push sleeve is maintained in a set position by the ratchet ring.

3. The method of claim 2, comprising the further step of pulling the mandrel to shear the at least one shear pin and move the shift sleeve system and the push sleeve to a released position, thereby decompressing the expandable packer element longitudinally.

* * * * *